US009186861B2

(12) United States Patent
Hattori

(10) Patent No.: US 9,186,861 B2
(45) Date of Patent: Nov. 17, 2015

(54) SHEET PROCESSING DEVICE AND IMAGE FORMING SYSTEM

(71) Applicant: Masato Hattori, Tokyo (JP)

(72) Inventor: Masato Hattori, Tokyo (JP)

(73) Assignee: KONICA MINOLTA BUSINESS TECHNOLOGIES, INC., Tokyo (JP)

( * ) Notice: Subject to any disclaimer, the term of this patent is extended or adjusted under 35 U.S.C. 154(b) by 404 days.

(21) Appl. No.: 13/674,198

(22) Filed: Nov. 12, 2012

(65) Prior Publication Data

US 2013/0123087 A1 May 16, 2013

(30) Foreign Application Priority Data

Nov. 15, 2011 (JP) ..... 2011-249596

(51) Int. Cl.

| | |
|---|---|
| ***B31F 1/00*** | (2006.01) |
| ***B65H 37/06*** | (2006.01) |
| ***B65H 29/60*** | (2006.01) |

(Continued)

(52) U.S. Cl.

CPC ..... *B31F 1/0009* (2013.01); *B65H 29/60* (2013.01); *B65H 31/3045* (2013.01); *B65H 37/04* (2013.01); *B65H 37/06* (2013.01); *B65H 39/10* (2013.01); *B65H 45/18* (2013.01); *G03G 15/6544* (2013.01); *B42C 1/12* (2013.01); *B65H 2301/322* (2013.01); *B65H 2301/33222* (2013.01); *B65H 2301/4213* (2013.01); *B65H 2301/4421* (2013.01); *B65H 2301/45* (2013.01); *B65H 2404/725* (2013.01); *B65H 2404/73* (2013.01); *B65H 2408/12* (2013.01); *B65H 2511/11* (2013.01); *B65H 2511/20* (2013.01); *B65H 2701/13212* (2013.01); *B65H 2701/1829* (2013.01); *B65H 2701/18271* (2013.01);

(Continued)

(58) Field of Classification Search

CPC ..... B31F 1/0009; B31F 1/00; G03G 2215/00877; B65H 45/18; B65H 37/06; B65H 39/10; B65H 29/60

USPC ..... 270/32, 45, 46, 51, 52.26, 58.07; 493/435, 442, 444

See application file for complete search history.

(56) References Cited

U.S. PATENT DOCUMENTS

| | | | | |
|---|---|---|---|---|
| 6,612,571 | B2 * | 9/2003 | Rider | 271/279 |
| 7,261,507 | B2 * | 8/2007 | Horii et al. | 412/35 |

(Continued)

FOREIGN PATENT DOCUMENTS

| | | |
|---|---|---|
| JP | 2005-096913 | 4/2005 |
| JP | 2006-264869 | 10/2006 |

(Continued)

OTHER PUBLICATIONS

Chinese Office Action dated Nov. 26, 2014 for corresponding Patent Application No. 201210451886.2 and English translation thereof.

(Continued)

*Primary Examiner* — Leslie A Nicholson, III

(74) *Attorney, Agent, or Firm* — Lucas & Mercanti, LLP

(57) ABSTRACT

In a sheet processing device, a sheet feeder feeds a sheet fed thereinto, by switching to any one of a first direction same as a feed-in direction of a sheet and a second direction orthogonal to the first direction. A second sheet processor is arranged in the second direction and performs a process including a center-folding process on the sheet. A first sheet processor is arranged in the first direction and performs a process other than the center-folding process on the sheet.

16 Claims, 19 Drawing Sheets

(51) Int. Cl.

| | |
|---|---|
| ***B65H 31/30*** | (2006.01) |
| ***B65H 37/04*** | (2006.01) |
| ***B65H 39/10*** | (2006.01) |
| ***G03G 15/00*** | (2006.01) |
| ***B65H 45/18*** | (2006.01) |
| *B42C 1/12* | (2006.01) |

(52) U.S. Cl.
CPC ... *B65H2701/18292* (2013.01); *B65H 2801/27* (2013.01); *G03G 2215/00877* (2013.01)

(56) References Cited

U.S. PATENT DOCUMENTS

| | | | | |
|---|---|---|---|---|
| 7,660,556 | B2 * | 2/2010 | Saitsu et al. | 399/407 |
| 7,766,322 | B2 | 8/2010 | Nakamura et al. | |
| 7,823,867 | B2 * | 11/2010 | Sato et al. | 270/58.09 |
| 8,123,209 | B2 * | 2/2012 | Kubota et al. | 270/58.07 |
| 8,240,651 | B2 | 8/2012 | Mitani | |
| 8,844,919 | B2 * | 9/2014 | Motoyoshi | 270/37 |
| 8,894,056 | B2 * | 11/2014 | Oshima | 270/52.26 |
| 2007/0001361 | A1 | 1/2007 | Nakamura et al. | |
| 2007/0228632 | A1 | 10/2007 | Sato et al. | |
| 2010/0150636 | A1 * | 6/2010 | Kubota et al. | 399/407 |
| 2011/0148023 | A1 | 6/2011 | Mitani | |

FOREIGN PATENT DOCUMENTS

| | | |
|---|---|---|
| JP | 2006-347634 | 12/2006 |
| JP | 2011-111243 | 6/2011 |
| JP | 2011-126674 | 6/2011 |

OTHER PUBLICATIONS

Japanese Office Action, Notice of Reasons for Rejection, Japanese Patent Application No. 2011-249596, Date of Drafting Oct. 28, 2013, Dispatch Date: Nov. 5, 2013 (3 pages).
English translation of Japanese Office Action, Notice of Reasons for Rejection, Japanese Patent Application No. 2011-249596, Date of Drafting Oct. 28, 2013, Dispatch Date: Nov. 5, 2013 (4 pages).
Office Action dated Jul. 10, 2015 issued from the corresponding Chinese patent application No. 201210451886.2.
English translation of Office Action dated Jul. 10, 2015 issued from the corresponding Chinese patent application No. 201210451886.2.

* cited by examiner

SHEET PROCESSING DEVICE AND IMAGE FORMING SYSTEM

CROSS REFERENCE TO RELATED APPLICATIONS

This application is entitled to and claims the benefit of Japanese Patent Application No. 2011-249596, filed on Nov. 15, 2011, the disclosure of which including the specification, drawings and abstract is incorporated herein by reference in its entirety.

BACKGROUND OF THE INVENTION

1. Field of the Invention

The present invention relates to a sheet processing device performing a process such as a sheet center-folding process and an image forming system including the sheet processing device.

2. Description of Related Art

Conventionally, devices have been proposed to perform a sheet processing including the sheet center-folding process.

Japanese Patent Application Laid-Open No. 2005-96913 discloses technology that changes the posture of a sheet, and then performs a center-folding process and a saddle-stitching process. In Japanese Patent Application Laid-Open No. 2005-96913, a manner of changing the sheet posture so as to achieve rapid and reliable changes in sheet posture with respect to various sheet sizes has been proposed.

Japanese Patent Application Laid-Open No. 2011-111243 discloses a device that forms a fold along a direction orthogonal to a sheet feed-in direction, and that feeds a sheet along the direction of the fold (i.e., the direction orthogonal to the feed-in direction).

On the other hand, the device disclosed in Japanese Patent Application Laid-Open No. 2005-96913 changes the posture of a sheet three times. Accordingly, because a mechanism for changing the posture of the sheet is complicated and extra space is required to change the posture of the sheet, it is thought that the device is more susceptible to increase in size.

In contrast, a device for forming a fold in a sheet along a direction orthogonal to the feed-in direction of the sheet and feeding the sheet along the direction of the fold, such as that disclosed in Japanese Patent Application Laid-Open 2001-111243, is not required to change the posture of the sheet much at all, and therefore is preferable because its configuration can be miniaturized.

However, the sheet processing device disclosed in Japanese Patent Application Laid-Open 2011-111243 is a device which is specialized to fold sheets. Thus, it is thought that the device may be practically insufficient as a finisher for an image forming device such as a copy machine and a laser beam printer. In other words, when the device is employed as the finisher for the image forming device, it is convenient if a mode for saddle-stitching or a mode for ejecting the sheet as it is can be selected in addition to a mode for center-folding the sheet.

However, with respect to conventional sheet processing devices which include the one disclose in Japanese Patent Application Laid-Open 2011-111243, a configuration which is capable of combining both a sheet center-folding process and a process other than center-folding (e.g., the type of arrangement of a part performing the center-folding and a part performing a process other than the center-folding within the device, and the manner in which sheets are fed) has not been sufficiently considered. Depending on an arrangement and feeding path, a problem may arise where the feeding path becomes complicated, thereby complicating and increasing the size of the overall configuration of the apparatus, and also the fractional sound of a sheet at the time of feeding.

SUMMARY OF THE INVENTION

A sheet processing device reflecting one aspect of the present invention includes a sheet feeder that feeds a sheet fed thereinto, by switching to any one of a first direction that is the same as a feed-in direction of a sheet and a second direction orthogonal to the first direction; a second sheet processor that is arranged in the second direction and that performs a process including a center-folding process on the sheet, and a first sheet processor that is arranged in the first direction and that performs a process other than the center-folding process on the sheet.

BRIEF DESCRIPTION OF DRAWINGS

The present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Hereinafter, embodiments of the present invention will be specifically described based on the accompanying drawings.

(1) Overall Configuration of System

Figure 1:
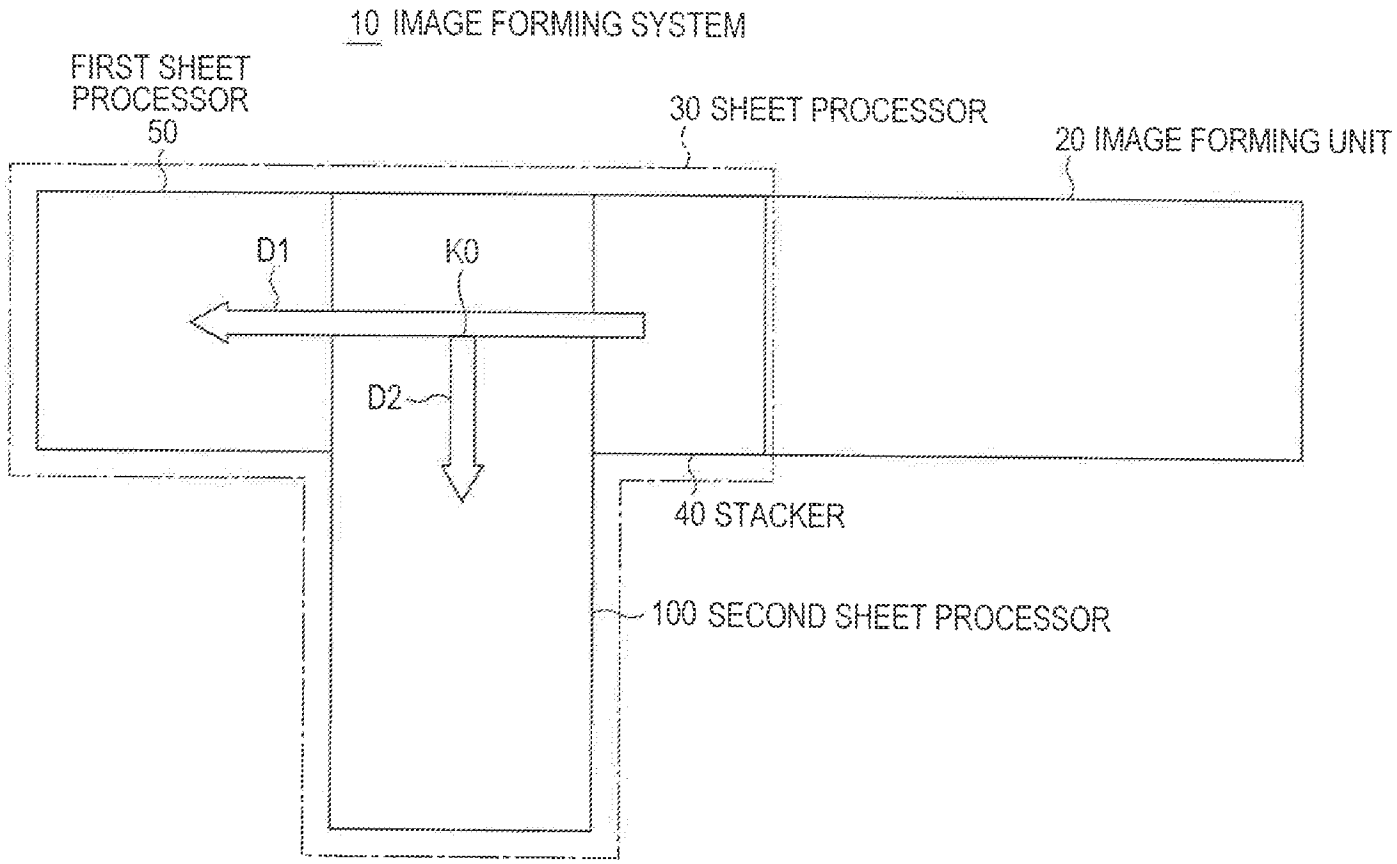
FIG. 1 is a schematic plan view showing an overall configuration of an image forming system that uses a sheet processing device of an embodiment.
Figure 2:
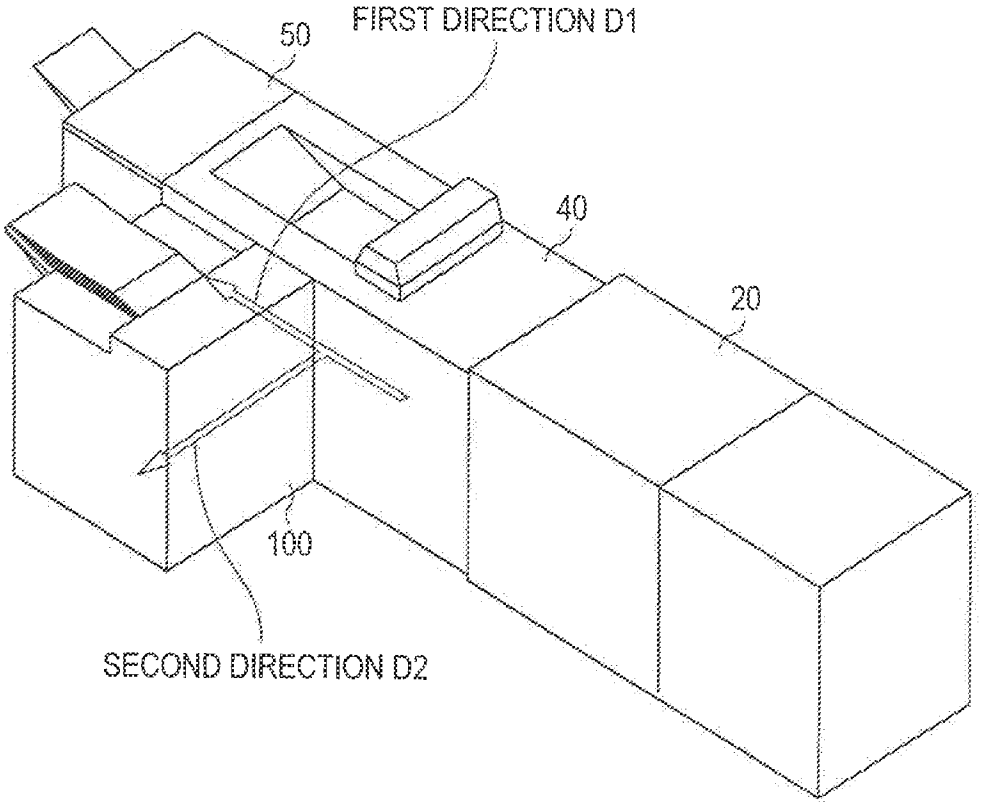
FIG. 2 is a schematic perspective view showing an exterior configuration of the image forming system.

FIG. 1 is a schematic plan view showing an overall configuration of an image forming system that uses a sheet processing device of an embodiment. FIG. 2 is a schematic perspective view showing an exterior configuration of the image forming system.

As shown in FIG. 1, image forming system 10 includes image forming unit 20 and sheet processor 30.

Image forming unit 20 forms an image which is a toner image on a sheet, and is the part referred to as a copy machine or a printer. Image forming unit 20 includes a scanner, an exposure device, a photoconductive drum, a developing device, and a fixing device, and/or the like, and is for forming a toner image on a sheet and ejecting the sheet on which the toner image has been formed.

Sheet processor 30 includes stacker 40, first sheet processor 50, and second sheet processor 100.

Sheet processor 30 is able to feed a sheet which has been fed thereinto (i.e., a printed sheet ejected from image forming unit 20) while switching to any one of first direction D1 which is the same direction as the feed-in direction of the sheet and second direction D2 which is orthogonal to first direction D1.

First sheet processor 50 is arranged in first direction D1. Second sheet processor 100 is arranged in second direction D2. In addition, second sheet processor 100 includes a common path forming feeding branch point 50 of first sheet processor 50 and second sheet processor 100. In other words, a printed sheet is fed into first sheet processor 50 via a part of second sheet processor 100.

First sheet processor 50 executes a process other than center-folding on the sheet. First sheet processor 50 is a sheet ejection tray, a side stitching stapler, a hole puncher, a case bookbinding (a glue binding) machine, and/or the like, which executes a bulk-loading process, a side-stitching process, a hole-punching process, a case bookbinding process, and/or the like, on printed sheets. Moreover, the configuration of first sheet processor 50 is not limited to one which executes a process mentioned above, and thus may execute another process other than center-folding.

Figure 3:
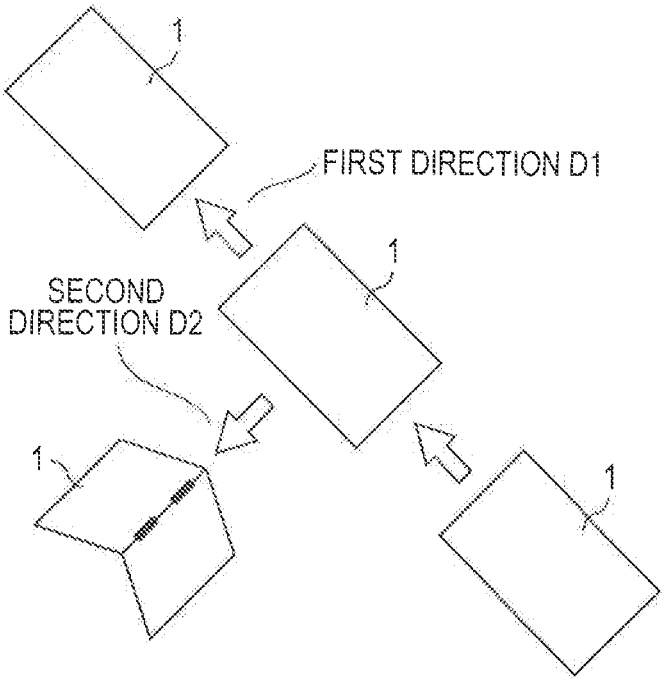
FIG. 3 is a diagram showing the state of a sheet fed in a first direction and the state of a sheet fed in a second direction.

Second sheet processor 100 executes a process including a center-folding process on the sheet. FIG. 3 shows the state of sheet 1 that is fed in any one of first direction D1 and second direction D2. Sheet 1 that is fed in first direction D1 is a sheet which has not been center-folded, and sheet 1 that is fed in second direction D2 is the sheet which has been center-folded. In the case of the present embodiment, second sheet processor 100 sequentially executes the center-folding process, a saddle-stitching process, a cutting process, and a loading process on sheet 1. The detailed configuration of second sheet, processor 100 will be described hereinafter.

Stacker 40 stacks a predetermined number of sheets, and ejects the sheets in the direction of the arrow shown in the drawings, namely, toward feeding branch point K0 (may also be referred to as "toward second sheet processor 100"). For example, five sheets stacked by stacker 40 are thereby simultaneously center-folding by second sheet processor 100. Moreover, providing stacker 40 allows for printed sheets to be stocked in stacker 40 (i.e., stacker 40 functions as a buffer) even when time is needed in first sheet processor 50 and second sheet processor 100 after stacking, so that the processing of image forming unit 20 in the previous stage does not have to be stopped and a reduction in productivity can be prevented.

(2) Configuration of Second Sheet Processor (2-1) Feeder Mechanism of Common Path and Center-Folding Mechanism Second sheet processor 100, a feeder mechanism of a common path including branch point K0 in FIG. 1, and a center-folding mechanism will be specifically described.

Figure 4:
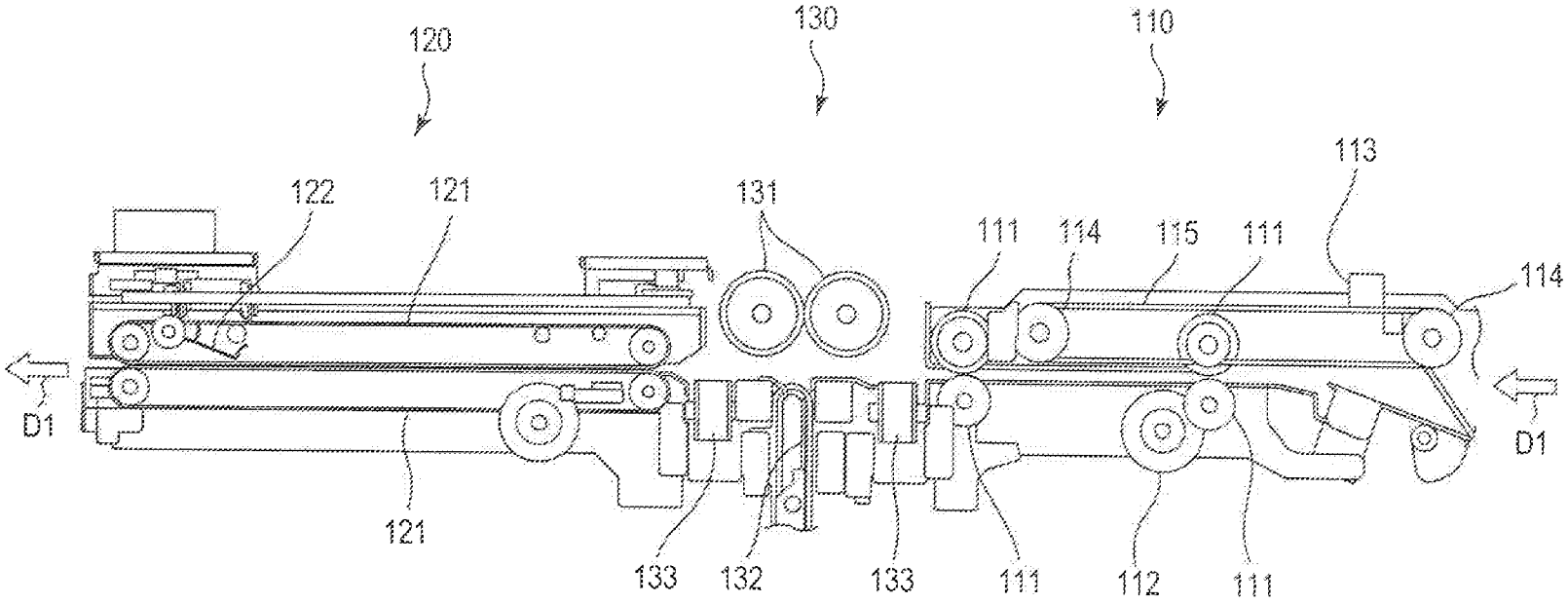
FIG. 4 is a side view showing a configuration for a feeder mechanism and for a center-folding mechanism at a common path.

FIG. 4 is a diagram showing a configuration for a feeder mechanism and for a center-folding mechanism at a common path. FIG. 4 is a side view showing second sheet processor 100 along arrow D1 in FIG. 1. In other words, in FIG. 4, stacker 40 is arranged on the right, first sheet processor 50 is arranged on the left, and second direction D2 runs toward the viewer of this drawing.

The feeder mechanism in FIG. 4 is mainly divided into sheet in-feeder 110, sheet out-feeder 120, and center-folder 130.

Sheet in-feeder 110 includes a pair of top and bottom feeder rollers 111. A sheet is sandwiched between feeder rollers 111, and is fed in first direction D1 by the torque of feeder rollers 111. Additionally, feeder rollers 111 are driven by drive gear 112.

Sheet in-feeder 110 includes biasing member 113. Biasing member 113 is fixed on the surface of timing belt 115 extended between drive pulleys 114, and is movable along with timing belt 115 in a clockwise direction and an anti-clockwise direction in the drawing.

Sheet out-feeder 120 includes a pair of top and bottom feeder belts 121. A sheet is sandwiched between top and bottom feeder belts 121, and is fed in first, direction D1 by the torque of feeder belts 121. A plurality of feeder belts 121 are arranged next to each other at predetermined intervals in a direction orthogonal to the plane of this drawing (refer to FIG. 10 for the arrangement of feeder rollers 111 and feeder belts 121).

Sheet out-feeder 120 includes front-end regulation member 122. Front-end regulation member 122 abuts against the front end of the sheet, and regulates the sheet front-end position. Furthermore, front-end regulation member 122 can enter and withdraw from a feeding path. FIG. 4 shows a state where front-end regulation member 122 is retracted from the feeding path. Furthermore, front-end regulation member 122 is movable in first direction D1 or in the opposite direction according to the size of the sheet that is fed thereinto.

Center-folder 130 includes two nip rollers 131, and thin-plate folding knife 132 for pushing the sheet between nip rollers 131. The rotational axis of nip rollers 131 is parallel to the rotational axes of feeder rollers 111 and drive gear 112. Both feeder rollers 111 and nip rollers 131 can be driven by drive gear 112. Accordingly, the driving source for sheet feeding and center-folding is easily shared by configuring second sheet processor 100 to include a common feeding path which forms a branch point of the feeding path in first direction D1 and the feeding path in second direction D2, and executing the center-folding process at the common feeding path. Moreover, a nip line of nip rollers 131 is orthogonal to first direction D1. Specifically, the nip line is formed in the direction orthogonal to the plane of the drawing.

The main operations performed by the feeder/center-folding mechanisms are as follows:

(i) Sheet Feed-In Operation (ii) Sheet Positioning Operation (iii) Center-folding Operation (iv) Sheet Ejection Operation in First Direction D1

(v) Sheet Ejection Operation in Second Direction D2

Hereinafter, each operation will be specifically described.

(i) Sheet Feed-In Operation

As shown in FIG. 4, top and bottom feeder rollers 111 are driven in a con tact state, and top and bottom feeder belts 121 are driven in a contact state. The sheet is sandwiched between top and bottom feeder rollers 111 and top and bottom feeder belts 121, and is fed in first direction D1. This sheet feeding operation ends slightly before the center of the sheet reaches folding knife 132.

(ii) Sheet Positioning Operation

Figure 5:
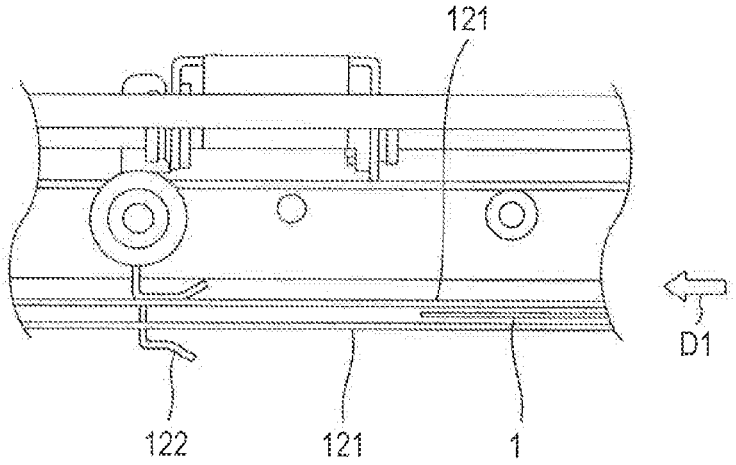
FIG. 5 is a side view showing a state of a front-end regulation member and a feeder belt at the time of sheet positioning.
Figure 6:
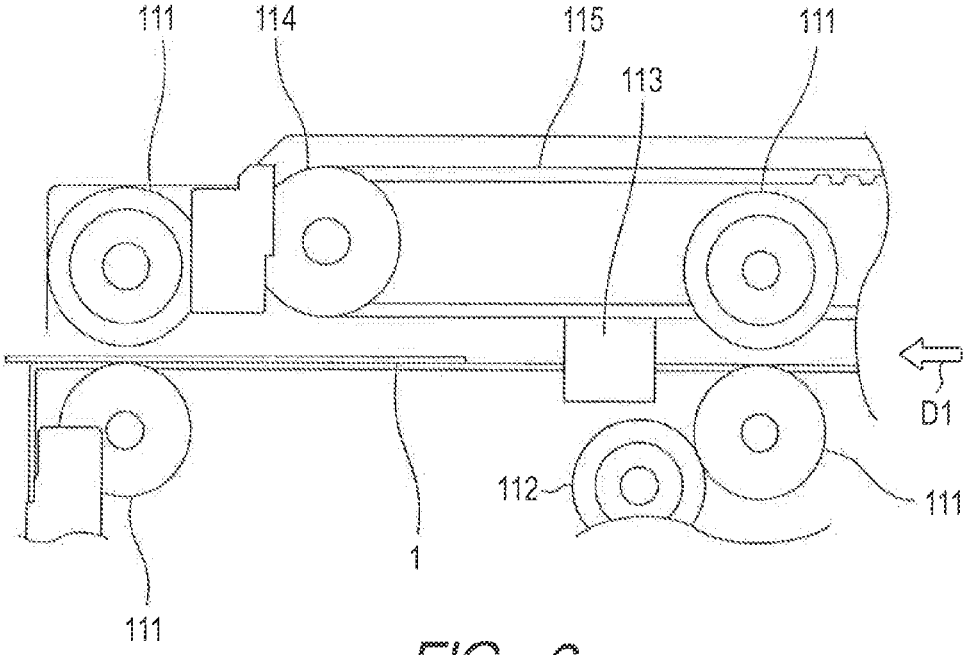
FIG. 6 is a side view showing a state of a biasing member and a feeder roller at the time of sheet positioning.

A sheet positioning operation is performed as preprocessing when the center-folding process is executed. As shown in FIG. 5, top and bottom feeder belts 121 are separated, and front-end regulation member 122 protrudes in front of sheet 1. Furthermore, as shown in FIG. 6, top and bottom feeder rollers 111 are separated. Because feeder belts 121 and feeder rollers 111 are separated in this manner, sheet 1 is released in first direction D1. In this state, timing belt 115 is rotated in the clockwise direction in the drawing by drive pulleys 114. Accordingly, biasing member 113 pushes the rear end of sheet 1, and biases the front end of sheet 1 toward front-end regulation member 122. Drive pulleys 114 stop and the positioning of sheet 1 is ended when the front end of sheet 1 reaches front-end regulation member 122. The protrusion position of front-end regulation member 122 in first direction D1 and the stop position of biasing member 113 (also referred to as the interval between front-end regulation member 122 and biasing member 113) are set according to the size of sheet 1 that is fed thereinto. In other words, the protrusion position of front-end regulation member 122 and the stop position of biasing member 113 are set based on the size of sheet 1 such that the center of sheet 1 is positioned at the position of folding knife 132. Moreover, the combination of front-end regulation member 122 and biasing member 113 forms a positioner of a first sheet feeder for feeding a sheet in first direction D1.

(iii) Center-folding Operation

Figure 7:
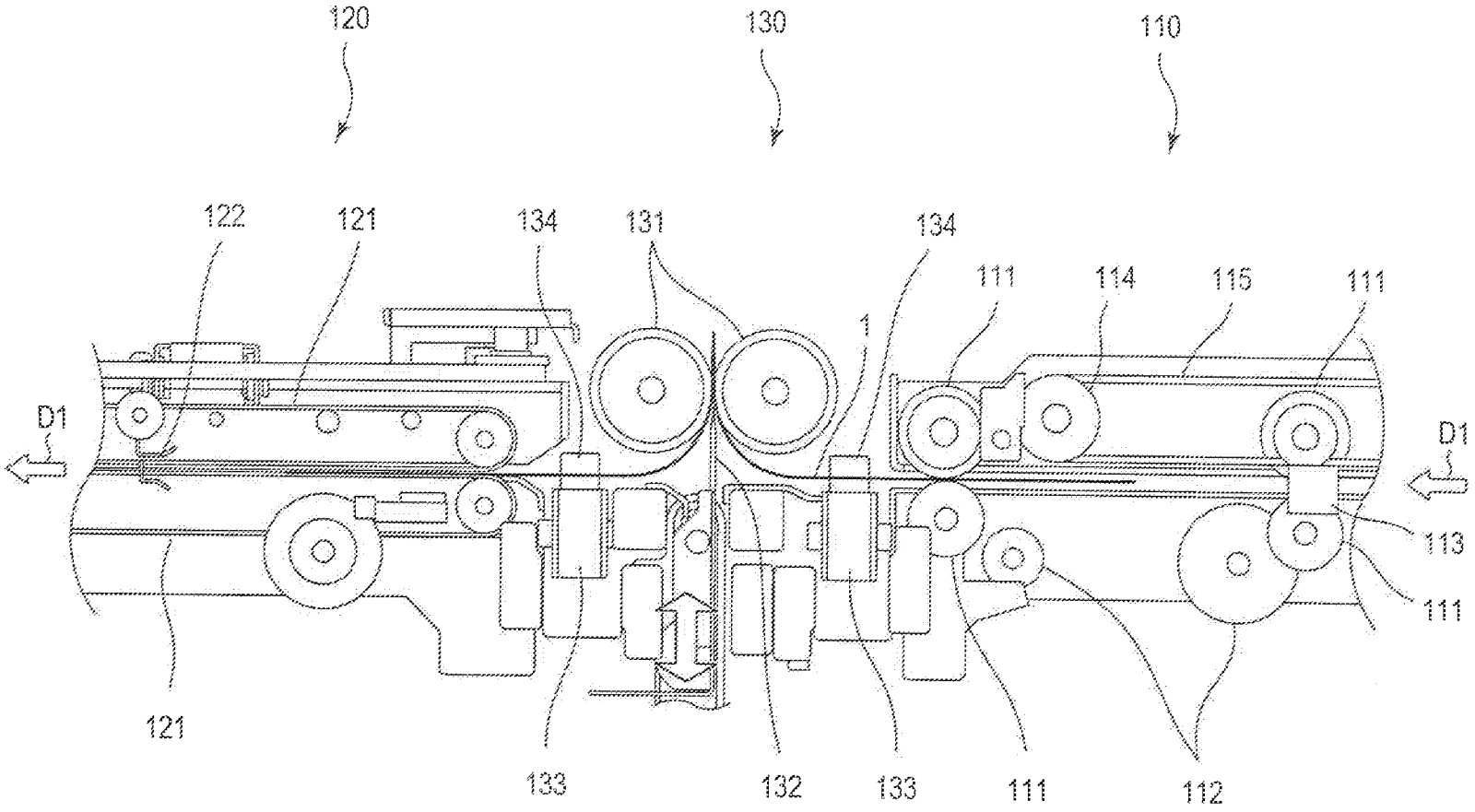
FIG. 7 is a side view showing a state of the feeder mechanism and the center-folding mechanism at the time of center-folding.

FIG. 7 is a diagram showing a state at the time of center-folding operation. As shown in FIG. 7, similar to the sheet positioning operation, folding knife 132 moves upward while top and bottom feeder belts 121 and top and bottom feeder rollers 111 are in a separated state (i.e., sheet 1 is in a released state). Accordingly, sheet 1 is pushed into nip rollers 131. Nip rollers 131 rotate until sheet 1 upwardly protrudes from the nip position, thereby causing a fold to be formed in sheet 1 via the pressure force of nip rollers 131. Afterwards, nip rollers 131 rotate in a reverse direction so that the sheet, in which a fold has been formed, drops off from nip rollers 131 and is returned to the feeding path.

(iv) Sheet Ejection Operation in First Direction D1

Figure 8:
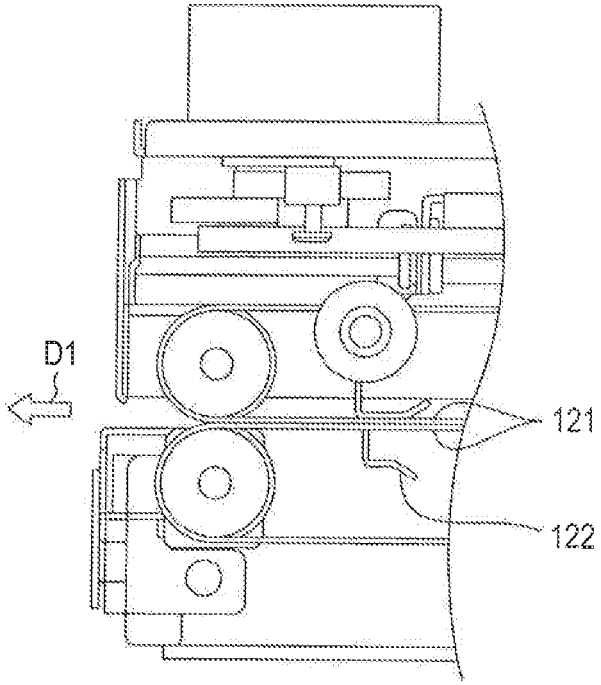
FIG. 8 is a side view showing the front-end regulation member in a protruded state.
Figure 9:
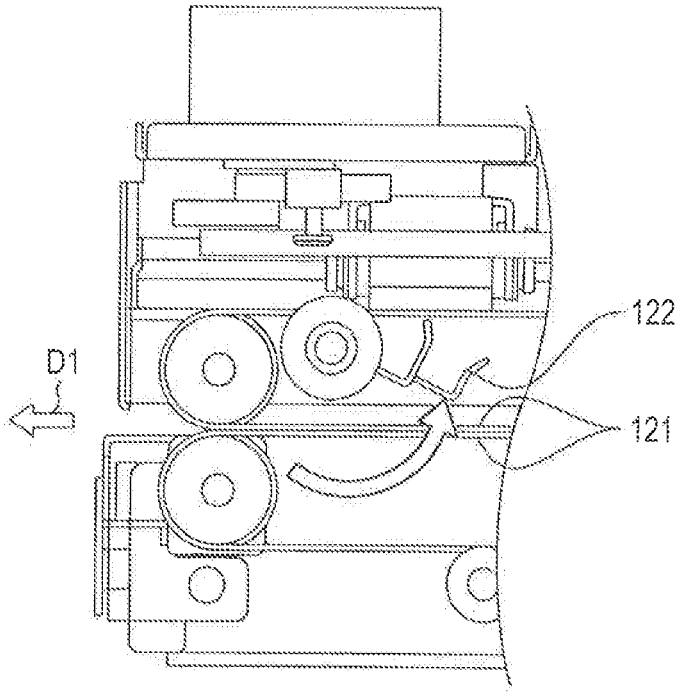
FIG. 9 is a side view showing the front-end regulation member in a retracted state.

When the sheet ejection operation is executed in first direction D1, the above mentioned sheet positioning operation and the center-folding operation are not executed, similarly to the sheet feeding operation, sheet 1 is sandwiched between top and bottom feeder rollers 111 and top and bottom feeder belts 121, fed in first direction D1, and ejected. At this time, it is impossible to eject the sheet with the front-end regulation member 122 staying in a protruded state such as shown in FIG. 8, and thus front-end regulation member 122 retracts from the feeding path and clears the feeding path in first direction D1 as shown in FIG. 9. Moreover, at least one of top and bottom feeder rollers 111 and top and bottom feeder belts 121 forms a sandwiching feeder in a first sheet feeder for feeding the sheet in first direction D1.

(v) Sheet Ejection Operation in Second Direction D2

Figure 10:
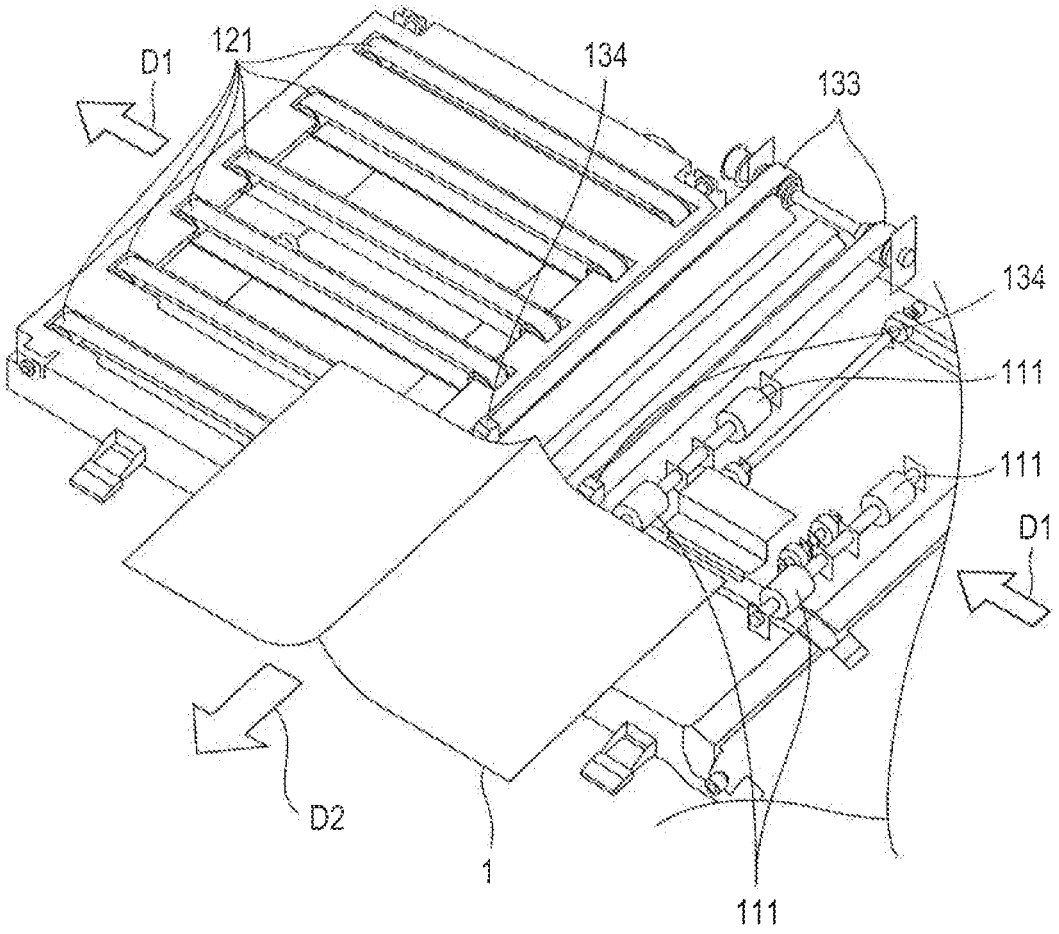
FIG. 10 is a diagram describing a sheet ejection operation in the second direction.

Sheet 1 in which a fold has been formed and which has been returned from nip rollers 131 to the feeding path is pushed in second direction D2 by pushing claw 134, as shown in FIG. 10. Pushing claw 134 is fixed to feeder belt 133, and is movable in second direction D2 together with feeder belt 133. In other words, pushing claw 134 moves in second direction D2 while being abutted against a side of sheet 1 which has been center-folded, so that center-folded sheet 1 is pushed in second direction D2. Moreover, similar to the sheet positioning operation and the center-folding operation, the sheet pushing operation in second direction D2 is performed while top and bottom feeder belts 121 and top and bottom feeder rollers 111 are in a separated state (i.e., sheet 1 is in a released state). Furthermore, pushing claw 134 forms a pushing device of a second sheet feeder for feeding the sheet in second direction D2.

(2-2) Saddle and Saddle-stitching Mechanisms

Figure 11:
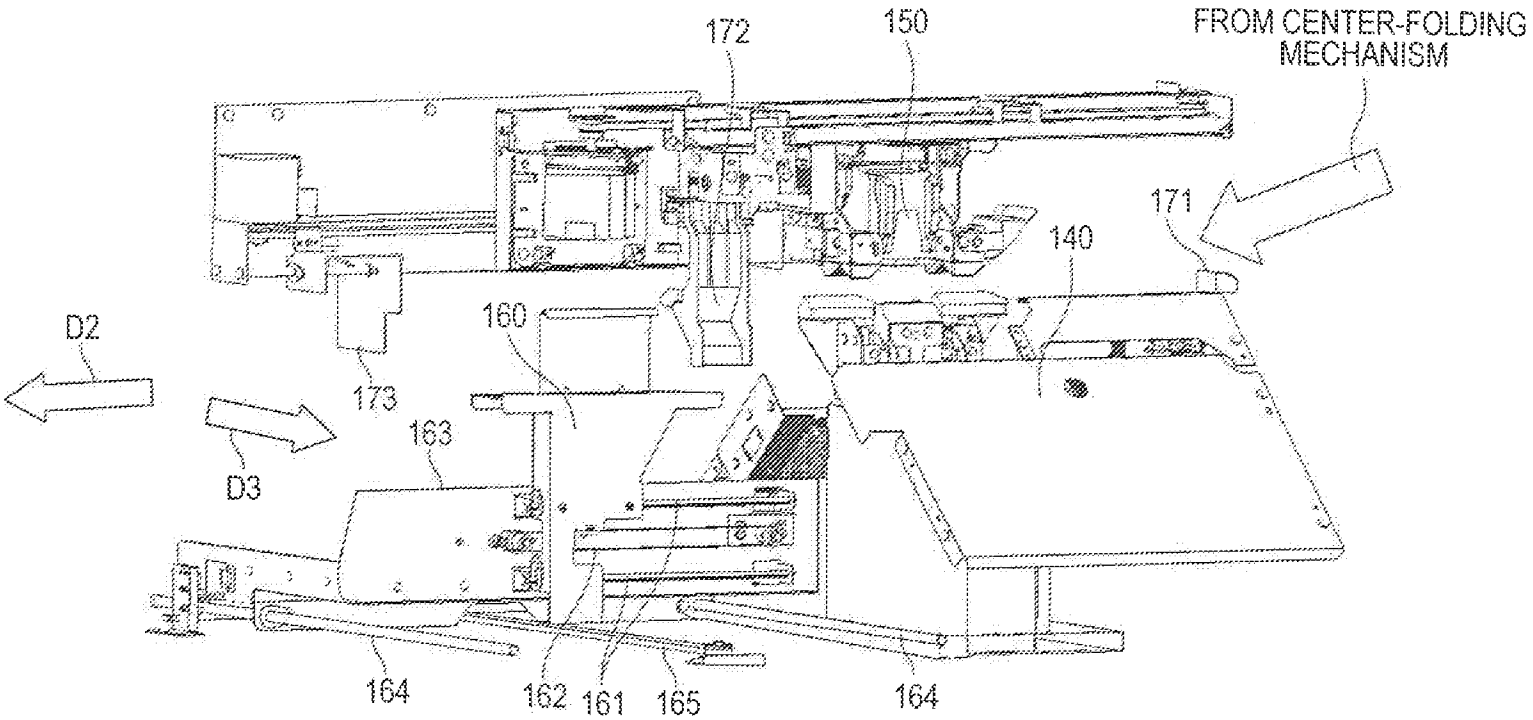
FIG. 11 is a perspective, view showing configurations for a saddling mechanism and a saddle-stitching mechanism.

FIG. 11 is a perspective view showing a configuration of a saddling mechanism and a saddle-stitching mechanism of the present embodiment. The saddling and saddle-stitching mechanisms of the present embodiment include main saddle 140, stapler 150, and buffer saddle 160.

Main saddle 140 is for placing center-folded sheet 1 ejected from the abovementioned center-folding mechanism, therein.

Stapler 150 is provided above main saddle 140, and descends toward main saddle 140 so as to saddle-stitch sheets placed on main saddle 140. Furthermore, the positions of main saddle 140 and stapler 150 are fixed with respect to second direction D2.

Buffer saddle 160 is provided separately from main saddle 140, and is movable with saddle-stitched sheets placed thereon. Main saddle 140 and buffer saddle 160 are serially arranged in the folding direction of center-folded sheets. Buffer saddle 160 is pivotally supported at slide shaft 161, and moved in second direction D2 and the opposite direction thereto by drive belt 162. Moreover, base 163 of buffer saddle 160 is pivotally supported at slide shaft 164, and moved in direction D3 orthogonal to second direction D2 and the opposite direction there to by drive belt 165.

Moreover, first feeding member 171, second feeding member 172, and positioning member 173 are provided in the saddling and saddle-stitching mechanisms. First feeding member 171, second feeding member 172, and positioning member 173 are respectively movable in second direction D2 and the opposite direction thereof.

Figure 12:
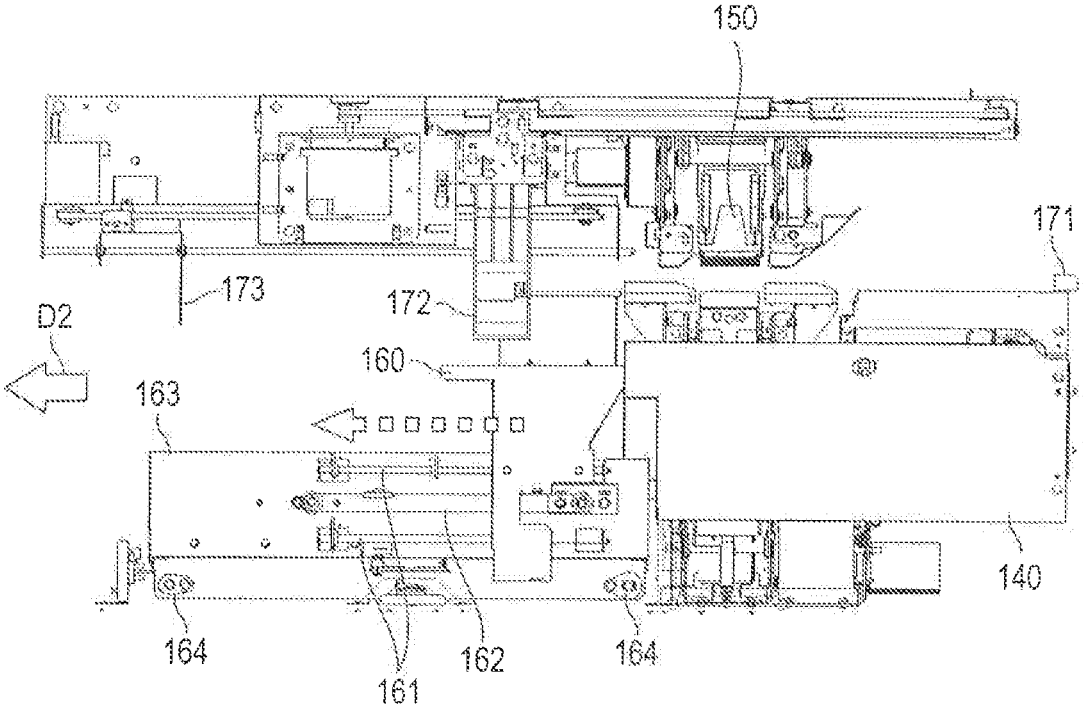
FIG. 12 is a side view showing a buffer saddle movement state.
Figure 13:
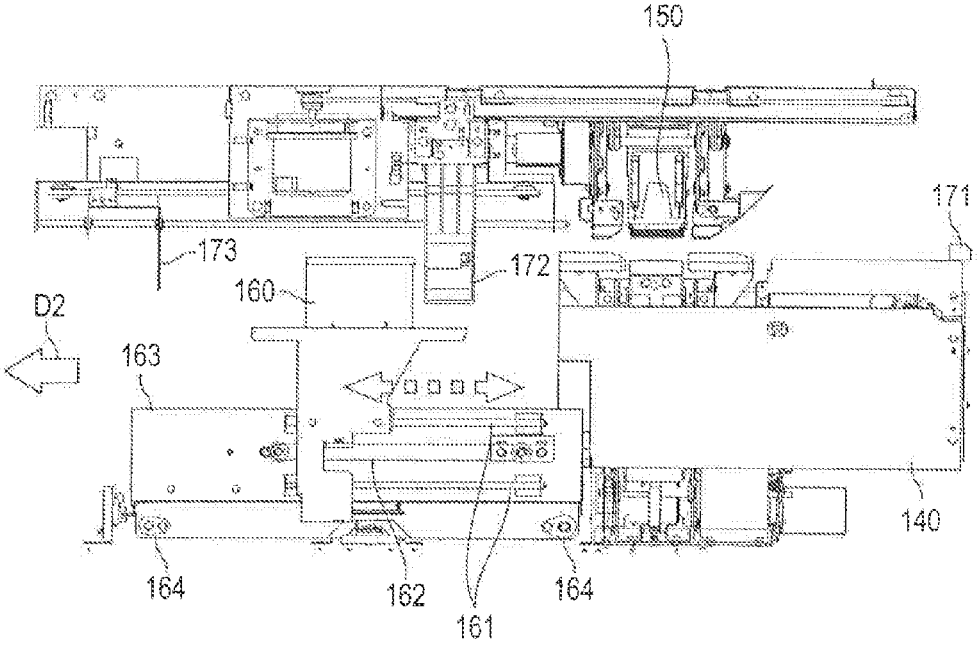
FIG. 13 is a side view showing a buffer saddle movement state.

FIGS. 12 and 13 show the movement of buffer saddle 160. FIG. 12 shows a state where buffer saddle 160 is nearest to main saddle 140, and thus saddle-stitching is executed by stapler 150 while in this state. FIG. 13 shows a state where buffer saddle 160 is farthest from main saddle 140 in second direction D2. Furthermore, when in the state shown in FIG. 13, saddle-stitched sheets are placed on buffer saddle 160. After buffer saddle 160 becomes a state which is the most separated from main saddle 140 in second direction D2, as shown in FIG. 13, buffer saddle 160 is moved in direction D3 (toward the viewer of FIG. 13) along slide shaft 164.

Next, an operation of the saddling mechanism and an operation of the saddle-stitching mechanism of the present embodiment will be described with reference to FIGS. 14A to 14E. FIGS. 14A to 14E are schematic views showing the saddling mechanism and the saddle-stitching mechanism from above.

Figure 14A:
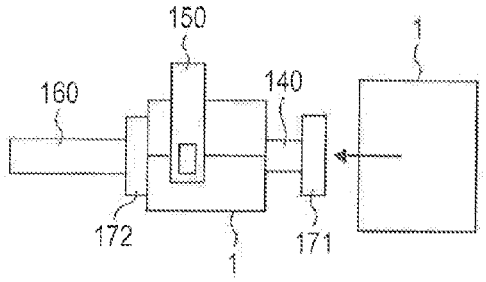
FIG. 14A is a top view describing an operation of the saddling mechanism and the saddle-stitching mechanism, and is a view showing a first state of the operation.

First, as shown in FIG. 14A, sheets 1 that are placed on main saddle 140 and center-folded nave the front end position thereof regulated by second feeding member 172, and a first stapling process executed by stapler 150.

Figure 14B:
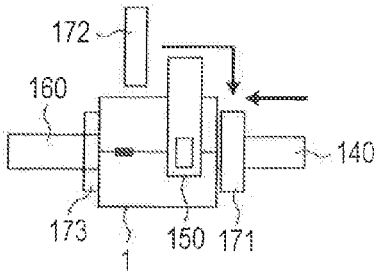
FIG. 14B is a top view describing the operation of the saddling mechanism and the saddle-stitching mechanism, and shows a second state of the operation.

Next, as shown in FIG. 14B, sheets 1 are moved in second direction D2 by pushing the rear end of sheets 1 by first feeding member 171. At this time, positioning member 173 is moved to the front end side of sheets 1, and sheets 1 are positioned by first feeding member 171 and positioning member 173 at a second staple position, and a second stapling process is performed at this position. Furthermore, part of the front end side of sheets 1 is placed on buffer saddle 160 while the second stapling process is being performed. Moreover, as shown in the diagram, second feeding member 172 moves around to the rear end side of sheets 1 while avoiding main saddle 140.

Figure 14C:
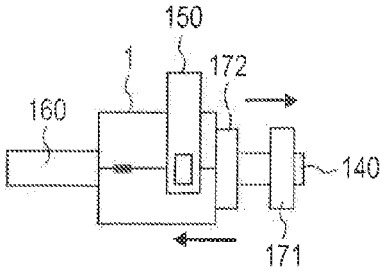
FIG. 14C is a top view describing the operation of the saddling mechanism and the saddle-stitching mechanism, and shows a third state of the operation.

Next, as shown in FIG. 14C, a saddle-stitched booklet is pushed at the rear end by second feeding member 172, and is moved toward buffer saddle 160. When this occurs, first feeding member 171 retracts backwards in order to receive the next sheet 1.

Figure 14D:
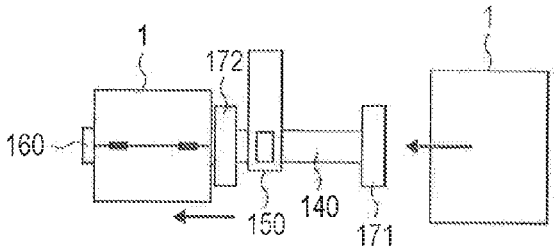
FIG. 14D is a top view describing the operation of the saddling mechanism and the saddle-stitching mechanism, and shows a fourth state of the operation.

Then, as shown in FIG. 14D, sheets (booklet) 1 are pushed at the rear end by second feeding member 172 until the sheets are placed completely on buffer saddle 160. When this occurs, buffer saddle 160 is in an independently movable state with booklet 1 placed thereon, and main saddle 140 is able to receive the next sheet 1.

Figure 14E:
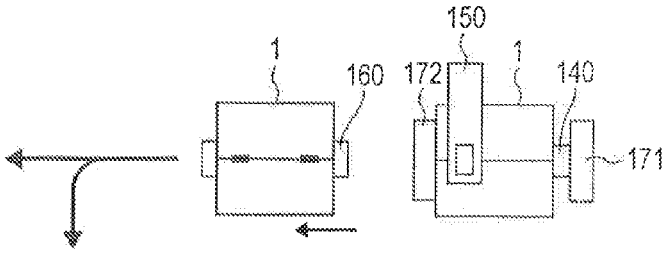
FIG. 14E is a top view describing the operation of the saddling mechanism and the saddle-stitching mechanism, and shows a fifth state of the operation.

Next, as shown in FIG. 14E, buffer saddle 160 has booklet 1 placed and feeds the booklet to the next processing position. Meanwhile, the next sheets 1 are placed on main saddle 140, and the saddle-stitching process is started.

Accordingly, providing main saddle 140 on which in-fed center-folded sheets 1 are to be placed, stapler 150 which is provided above main saddle 140 and which is for saddle-stitching sheets 1 placed on main saddle 140, and buffer saddle 160 which is provided separately from main saddle 140 and which is movable with saddle-stitched sheets 1 placed thereon, allows the saddle-stitching process to be carried out by main saddle 140, and the feeding of sheets 1 to be carried out by buffer saddle 160. As a result, a saddling mechanism that is needed to perform both saddle-stitching and feeding of sheets with a simple configuration and high-speed processing can be achieved.

Moreover, setting fixed positions to second direction D2 for stapler 150 and a member that receives stapler 150 at main saddle 140 side at the time of stapling and to move sheets 1 in second direction D2 by first feeding member 171 and second feeding member 172, so that the positional relationship of stapler 150 and the member that receives stapler 150 at main saddle 140 side at the time of stapling is not shifted, and the bending of the legs of a staple can be performed stably and highly accurately at the time of stapling. As a result, the accuracy of saddle-stitching is increased. Furthermore, the level of silence can be increased.

(2-3) Configurations of Cutter, Sheet Tray and Lifter

Figure 15:
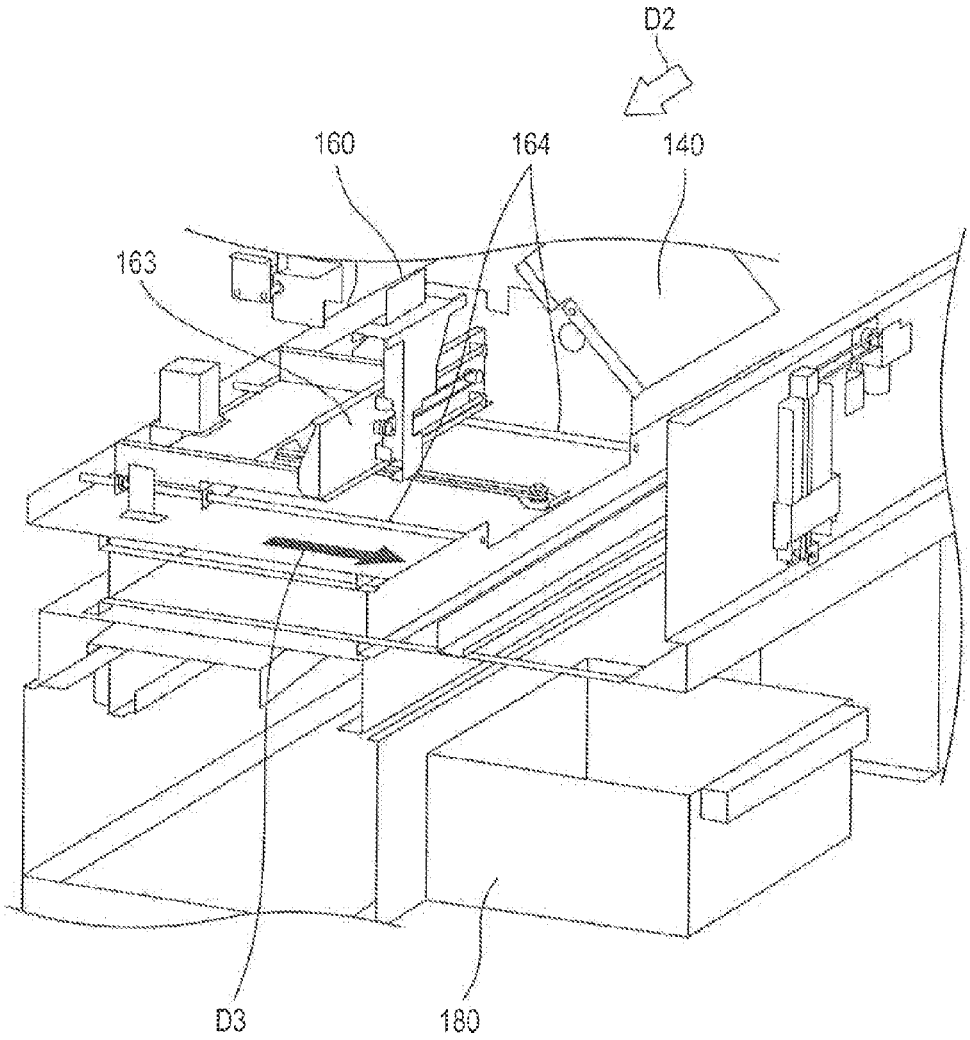
FIG. 15 is a diagram showing an arrangement of a cutter.

As shown in FIG. 15, cutter 180 is arranged in direction D3, which is the direction that buffer saddle 160 moves. Cutter 180 includes a cutter blade (not shown), and cuts an edge portion opposite the saddle-stitched side of a saddle-stitched booklet.

Figure 16:
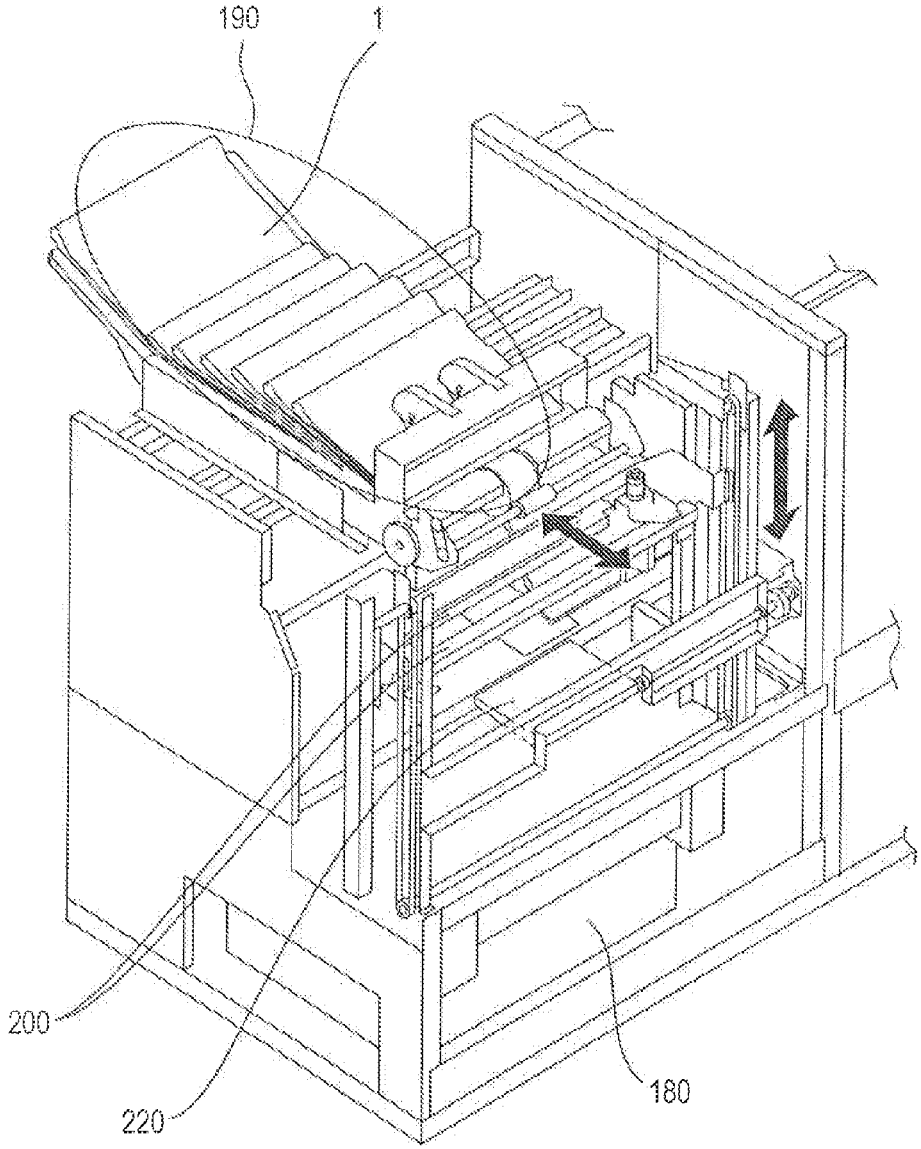
FIG. 16 is a perspective view showing an arrangement of the cutter, an ejected sheet tray and a lifter.

FIG. 16 shows the arrangement of the cutter, the sheet tray and the lifter. Cutter 180 is arranged at a position below buffer saddle 160. Ejected sheet tray 190 is arranged above cutter 180. In the present embodiment, ejected sheet tray 190 is provided above second sheet processor 100. Lifter 200 receives a saddle-stitched booklet from buffer saddle 160, lowers the booklet to cutter 180 in a vertically held state, and raises the booklet from cutter 180 to ejected sheet tray 190.

Accordingly, arranging ejected sheet tray 190 above cutter 180 allows a user to easily take the booklet. Moreover, the installation area of the device can be miniaturized.

Figure 17:
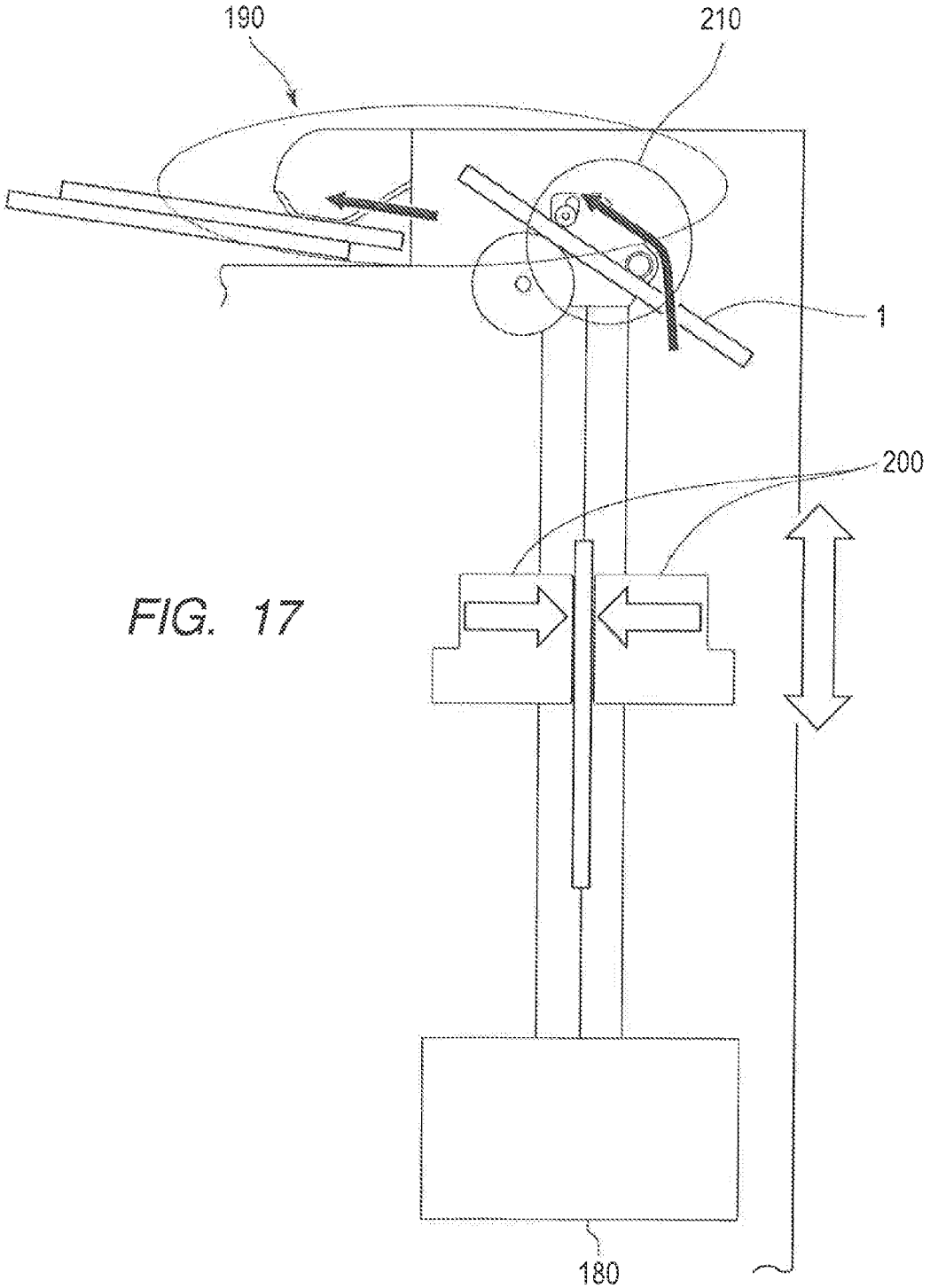
FIG. 17 is a side view showing an arrangement of the cutter, the ejected sheet tray and the lifter.
Figure 18:
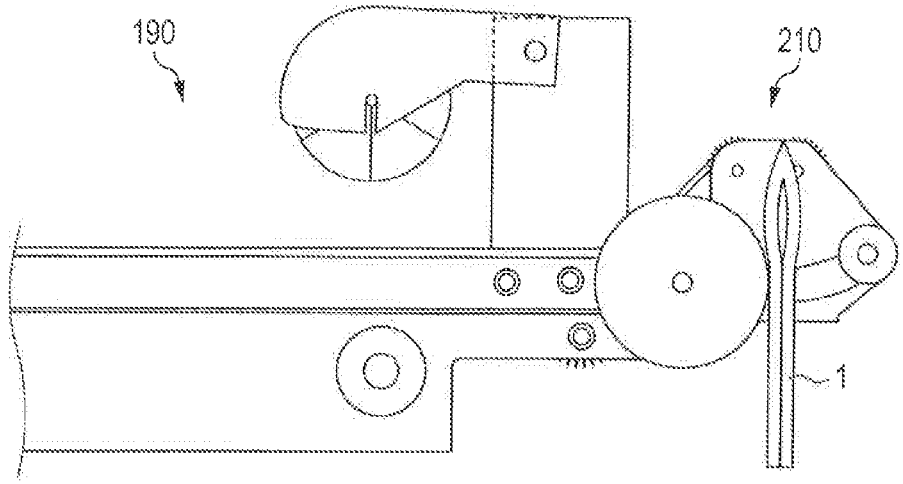
FIG. 18 is a side view describing a direction changer.
Figure 19:
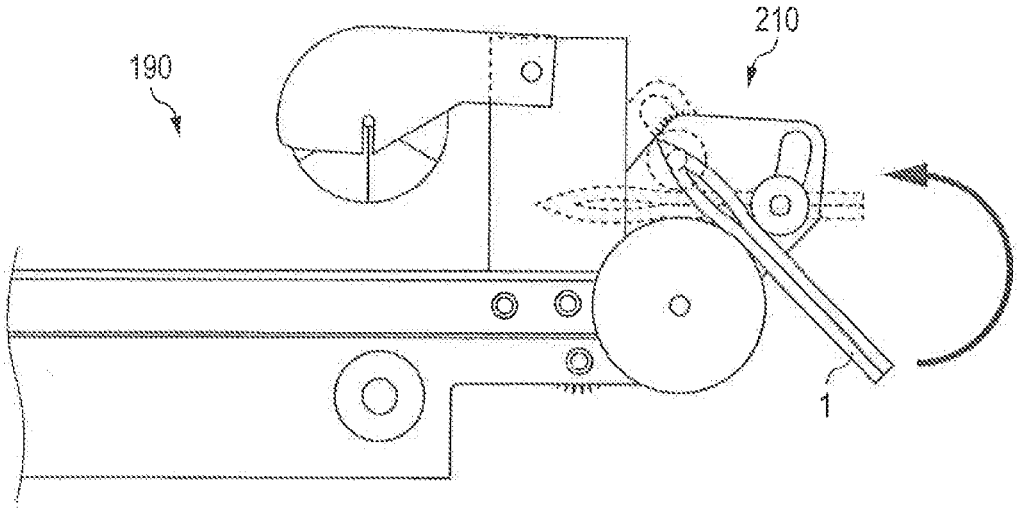
FIG. 19 is a side view describing the direction changer.

As shown in FIGS. 17, 18 and 19, direction changer 210 is provided at the opening of ejected sheet tray 190. Direction changer 210 is a clamping mechanism, which changes the direction of booklet 1 that is vertically held by lifter 200 so as to be substantially horizontal, and places booklet 1 on ejected sheet tray 190.

Figure 20:
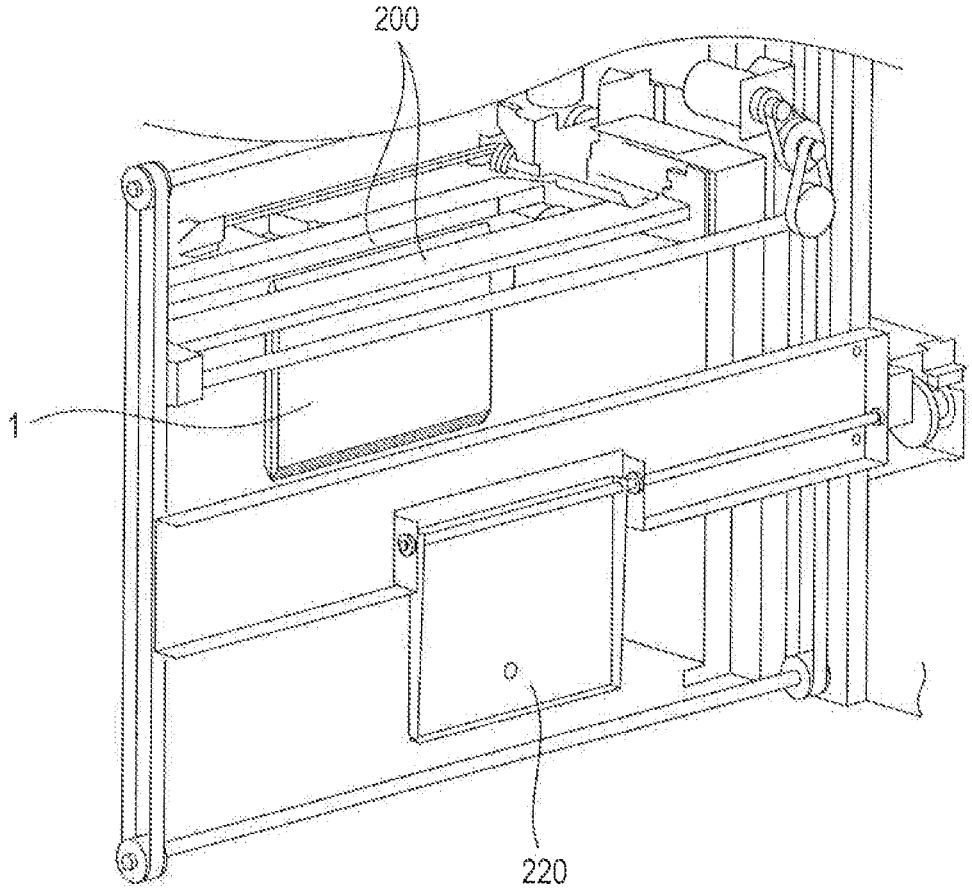
FIG. 20 is a perspective view describing a change in the holding position of the lifter.
Figure 21:
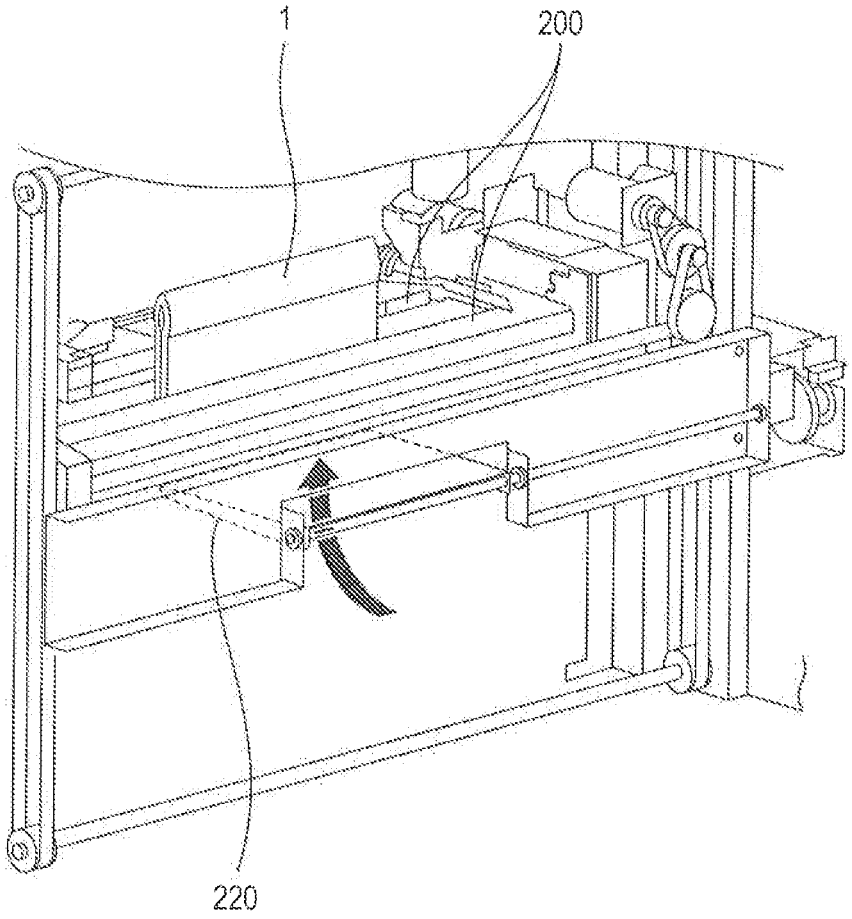
FIG. 21 is a perspective view describing a change in the holding position of the lifter.

As shown in FIGS. 20 and 21, lifter 200 can change the position of holding booklet 1 between a first holding position and a second holding position which is lower than the first holding position. Lifter 200 changes the position of holding booklet 1 from the first holding position to the second holding position when booklet 1 is raised from cutter 180 to ejected sheet tray 190.

In the present embodiment, retaining plate 220 is provided in order to change the holding position.

Figure 22:
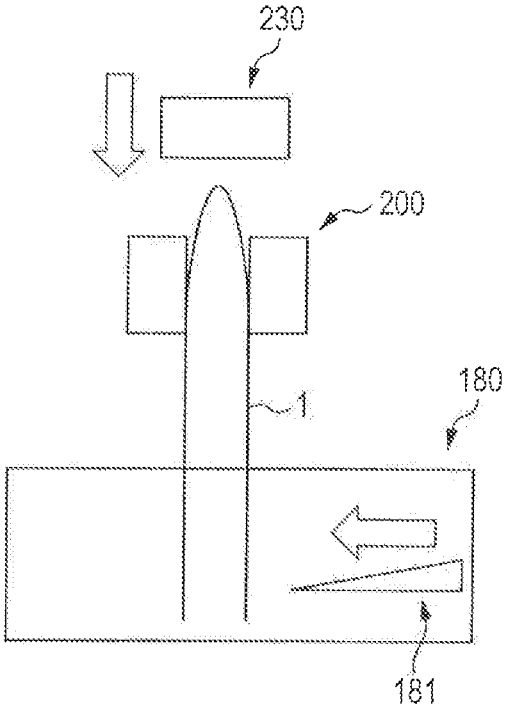
FIG. 22 is a diagram describing a square-folding process.

An operation will be described. First, lifter 200 performs a square folding process via square folding member 230, as shown in FIG. 22, while holding a portion in the vicinity of the upper end (the fold) of booklet 1, as shown in FIG. 20, then booklet 1 is lowered onto cutter 180, and a cutting process is performed by cutter blade 181 of cutter 180. Afterwards, the cut booklet 1 is raised. At this time, retaining plate 220 is in a vertical state, as shown in FIG. 20.

Then, after lifter 200 is raised to a certain position, retaining plate 220 is rotated so as to be in a horizontal state, as shown in FIG. 21, and booklet 1 is placed on the top surface of retaining plate 220. Accordingly, lifter 200 changes the holding position to the second holding position below the first holding position while booklet 1 is retained in retaining plate 220.

Holding the tipper end proximity (the fold) of booklet 1 and accurately closing booklet 1 allows an accurate square folding process and a cutting process to be performed. Moreover, changing the holding position to the second holding position lower than the first holding position allows direction changer 210 positioned above cutter 180 to appropriately receive booklet 1.

As described above, according to the present embodiment, a sheet feeder (feeder rollers 111, feeder belts 121, pushing claw 134) that feeds a sheet fed thereinto by switching to any one of first direction D1 that is the same as a feed-in direction of sheet 1 and second direction D2 orthogonal to first direction D1, second sheet processor 100 that is arranged in second direction D2 and that performs a process including the center-folding process on sheet 1, and first sheet processor 50 that is arranged in first direction D1 and that performs a process other than the center-folding process on sheet 1. Accordingly, omitting the needless movement of sheets, and performing a sheet process that includes sheet center-folding and a sheet process that does not include sheet center-folding is possible. As a result, a sheet processing device can be achieved which has a relatively simple configuration and excellent low-noise property, and which is capable of performing a plurality of sheet, processes including high-speed center-folding.

Moreover, because second sheet processor 100 is configured to include a common feeding path forming a branch point of a feeding path in first direction D1 and a feeding path in second direction D2, and the center-folding process is performed at the common feeding path, the driving source for sheet feeding and center-folding can be easily shared and the configuration can be simplified.

Furthermore, because a common feeding path that forms a branch point of the feeding path in first direction D1 and the feeding path in second direction D2 is arranged in one plane, and sheets 1 are separated and fed in first direction D1 and second direction D2 on the plane, sheets can be separated within a small space and the device can be miniaturized.

An invention made by the present inventor has been specifically described above based on an exemplary embodiment. However, the present invention is not limited to the embodiment described above, and changes can be made without departing from the spirit of the invention.

In the embodiment described above, a case is described where feeder rollers 111, feeder belts 121, and pushing claw 134 are used as the sheet feeder that feeds a sheet, which has been fed thereinto, by switching to any one of first direction D1 that is the same as a feed-in direction of sheet 1 and second direction D2 orthogonal to first direction D1, but the configuration of the sheet feeder is not limited to such an embodiment.

The embodiment disclosed herein is exemplary in every aspect, and therefore not understood to be restrictive. The scope of the present invention is indicated not by the description above, but by the appended claims, and all modifications equivalent in meaning and scope to the claims fall within the scope of the claimed invention.

What is claimed is:

1. A sheet processing device comprising:

a sheet feeder that feeds a sheet, which has been fed thereinto, by switching to anyone of a first direction that is the same as a feed-in direction of the sheet and a second direction orthogonal to the first direction;

a second sheet processor that is arranged in the second direction and that performs a process including a center-folding process on the sheet; and a first sheet processor that is arranged in the first direction and that performs a process other than the center-folding process on the sheet, wherein the second sheet processor includes a common feeding path that forms a branch point for a feeding path in the first direction and a feeding path in the second direction, the center-folding process is performed at the common feeding path, the common feeding path is arranged in one plane, and sheets are separated and fed in the first direction and the second direction in the one plane.

2. The sheet processing device according to claim 1, wherein the second sheet processor includes a center-folder, the center-folder includes two nip rollers, and a plate-shaped folding knife for pushing the sheet between the nip rollers, and rotational axes of the nip rollers are in parallel to a rotational drive axis of a first sheet feeder for feeding the sheet in the first direction, and a nip line of the nip rollers is orthogonal to the first direction.

3. The sheet processing device according to claim 1, wherein the sheet feeder comprises a first sheet feeder for feeding the sheet in the first direction includes a sandwiching feeder which is formed from a set of feeder rollers or a set of feeder belts arranged at positions so as to sandwich the sheet a long the first direction, and which feeds the sheet in the first direction in which the sheet is sandwiched, and the sandwiching feeder is capable of switching between a sandwiched state where the sheet is sandwiched and a released state where the sheet is released.

4. The sheet processing device according to claim 3, wherein the sheet feeder comprises a second sheet feeder for feeding the sheet in the second direction includes a pushing device that pushes the sheet which is center-folded in the second direction by moving in the second direction while being abutted against a side of the sheet which is center-folded, and the pushing device pushes the sheet which is center-folded in the second direction when the sandwiching feeder of the first sheet feeder is in the released state.

5. The sheet processing device according to claim 3, wherein the first sheet feeder includes:

a positioner that positions a sheet, the positioner includes:

a front-end regulation member that abuts against a front end of the sheet which is fed and regulates a front-end position of the sheet, and a biasing member that pushes a rear end of the sheet and biases the front end of the sheet toward the front-end regulation member, the front-end regulation member and the biasing member are configured so as to be movable to a position which corresponds to the size of a sheet that is to be fed, and to be able to enter and withdraw from a feeding path, and the front-end regulation member and the biasing member protrude in the feeding path so as to position the sheet at a center-folding position in a case where the center-folding process is to be performed on the sheet, and retract from the feeding path so as to clear a feeding path to the first direction in a case where the sheet is to be moved in the first direction.

6. The sheet processing device according to claim 5, wherein in a case where the sheet is to be center-folded, the front-end regulation member protrudes to a predetermined position in the feeding path, the sandwiching feeder sandwiches and feeds the sheet in the first direction until the front end of the sheet reaches a front position of the front-end regulation member, and releases the sheet at the front position, and the biasing member feeds the sheet in the first direction until the front end of the sheet reaches the front-end regulation member by pushing the rear end of the sheet released from the sandwiching feeder.

7. The sheet processing device according to claim 1, furthermore comprising:

two nip rollers that are arranged above the common feeding path; and a plate-shaped folding knife that is arranged to be able to enter and withdraw from below the common feeding path toward the nip rollers and that pushes the sheet between the nip rollers at a time of protruding, wherein the nip rollers form a fold in the sheet by forwardly rotating and pulling in the sheet, and return a sheet in which a fold has been formed on the common feeding path by reversely rotating.

8. An image forming system comprising:

an image forming unit that forms an image on a sheet; and the sheet processing device according to claim 1.

9. A sheet processing device comprising:

a sheet feeder that feeds a sheet, which has been fed thereinto, by switching to anyone of a first direction that is the same as a feed-in direction of the sheet and a second direction orthogonal to the first direction;

a second sheet processor that is arranged in the second direction and that performs a process including a center-folding process on the sheet; and a first sheet processor that is arranged in the first direction and that performs a process other than the center-folding process on the sheet, wherein the sheet feeder comprises a first sheet feeder for feeding the sheet in the first direction includes a sandwiching feeder which is formed from a set of feeder rollers or a set of feeder belts arranged at positions so as to sandwich the sheet a long the first direction, and which feeds the sheet in the first direction in which the sheet is sandwiched, the sandwiching feeder is capable of switching between a sandwiched state where the sheet is sandwiched and a released state where the sheet is released, the sheet feeder comprises a second sheet feeder for feeding the sheet in the second direction includes a pushing device that pushes the sheet which is center-folded in the second direction by moving in the second direction while being abutted against a side of the sheet which is center-folded, and the pushing device pushes the sheet which is center-folded in the second direction when the sandwiching feeder of the first sheet feeder is in the released state.

10. The sheet processing device according to claim 9, wherein the second sheet processor includes a common feeding path that forms a branch point for a feeding path in the first direction and a feeding path in the second direction, and the center-folding process is performed at the common feeding path.

11. The sheet processing device according to claim 10, wherein the common feeding path is arranged in one plane, and sheets are separated and fed in the first direction and the second direction in the one plane.

12. An image forming system comprising:

an image forming unit that forms an image on a sheet; and the sheet processing device according to claim 9.

13. A sheet processing device comprising:

a sheet feeder that feeds a sheet, which has been fed thereinto, by switching to anyone of a first direction that is the same as a feed-in direction of the sheet and a second direction orthogonal to the first direction;

a second sheet processor that is arranged in the second direction and that performs a process including a center-folding process on the sheet; and a first sheet processor that is arranged in the first direction and that performs a process other than the center-folding process on the sheet, wherein the sheet feeder comprises a first sheet feeder for feeding the sheet in the first direction includes a sandwiching feeder which is formed from a set of feeder rollers or a set of feeder belts arranged at positions so as to sandwich the sheet a long the first direction, and which feeds the sheet in the first direction in which the sheet is sandwiched, the sandwiching feeder is capable of switching between a sandwiched state where the sheet is sandwiched and a released state where the sheet is released, the first sheet feeder includes:

a positioner that positions a sheet, the positioner includes:

a front-end regulation member that abuts against a front end of the sheet which is fed and regulates a front-end position of the sheet, and a biasing member that pushes a rear end of the sheet and biases the front end of the sheet toward the front-end regulation member, the front-end regulation member and the biasing member are configured so as to be movable to a position which corresponds to the size of a sheet that is to be fed, and to be able to enter and withdraw from a feeding path, and the front-end regulation member and the biasing member protrude in the feeding path so as to position the sheet at a center-folding position in a case where the center-folding process is to be performed on the sheet, and retract from the feeding path so as to clear a feeding path to the first direction in a case where the sheet is to be moved in the first direction.

14. The sheet processing device according to claim 13, wherein the second sheet processor includes a common feeding path that forms a branch point for a feeding path in the first direction and a feeding path in the second direction, and the center-folding process is performed at the common feeding path.

15. The sheet processing device according to claim 14, wherein the common feeding path is arranged in one plane, and sheets are separated and fed in the first direction and the second direction in the one plane.

16. An image forming system comprising:

an image forming unit that forms an image on a sheet; and the sheet processing device according to claim 13.

* * * * *